US011050148B2

(12) United States Patent
Lo et al.

(10) Patent No.: US 11,050,148 B2
(45) Date of Patent: Jun. 29, 2021

(54) ANTENNA STRUCTURE

(71) Applicant: Quanta Computer Inc., Taoyuan (TW)

(72) Inventors: Chung-Hung Lo, Taoyuan (TW); Yi-Ling Tseng, Taoyuan (TW); Chin-Lung Tsai, Taoyuan (TW); Ching-Hai Chiang, Taoyuan (TW); Kuan-Hsien Lee, Taoyuan (TW); Ying-Cong Deng, Taoyuan (TW); Chung-Ting Hung, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 30 days.

(21) Appl. No.: 16/661,319

(22) Filed: Oct. 23, 2019

(65) Prior Publication Data

US 2020/0411987 A1 Dec. 31, 2020

(30) Foreign Application Priority Data

Jun. 28, 2019 (TW) ..... 108122731

(51) Int. Cl.
*H01Q 5/307* (2015.01)
*H01Q 9/42* (2006.01)
*H01Q 1/48* (2006.01)

(52) U.S. Cl.
CPC ..... *H01Q 5/307* (2015.01); *H01Q 1/48* (2013.01); *H01Q 9/42* (2013.01)

(58) Field of Classification Search
CPC ..... H01Q 5/307; H01Q 5/314; H01Q 5/321; H01Q 5/378; H01Q 1/243; H01Q 9/42; H01Q 1/48
See application file for complete search history.

(56) References Cited

U.S. PATENT DOCUMENTS 8,823,591 B2 * 9/2014 Ying ..... H01Q 5/385 343/702
9,035,837 B2 * 5/2015 Kwak ..... H01Q 5/321 343/745

(Continued)

FOREIGN PATENT DOCUMENTS

CN 104377430 B 5/2017
TW M407498 U 7/2011

(Continued)

OTHER PUBLICATIONS

Chinese language office action dated Feb. 26, 2020, issued in application No. TW 108122731.

(Continued)

*Primary Examiner* — Dameon E Levi
*Assistant Examiner* — Jennifer F Hu
(74) *Attorney, Agent, or Firm* — McClure, Qualey & Rodack, LLP

(57) ABSTRACT

An antenna structure includes a ground element, a feeding radiation element, a first radiation element, a second radiation element, a third radiation element, a first capacitor, and a second capacitor. The ground element has a notch region. The feeding radiation element has a feeding point. The first radiation element is coupled to the ground element. The first capacitor is coupled between the feeding radiation element and the first radiation element. The second radiation element is coupled to the ground element. The second capacitor is coupled between the first radiation element and the second radiation element. The third radiation element is coupled to the feeding radiation element. The feeding radiation element, the first radiation element, the second radiation element, the third radiation element, the first capacitor, and the second capacitor are all disposed inside the notch region of the ground element.

4 Claims, 4 Drawing Sheets

(56) References Cited

U.S. PATENT DOCUMENTS

| | | | | |
|---|---|---|---|---|
| 2011/0032165 | A1* | 2/2011 | Heng | H01Q 19/005 343/745 |
| 2012/0162016 | A1 | 6/2012 | Lin | |
| 2013/0050036 | A1* | 2/2013 | Kashiwagi | H01Q 5/321 343/749 |
| 2013/0234903 | A1* | 9/2013 | Kwak | H01Q 5/321 343/750 |
| 2015/0061949 | A1* | 3/2015 | Lee | H01Q 9/42 343/722 |
| 2018/0026371 | A1* | 1/2018 | Chang | H01Q 1/38 343/833 |
| 2018/0278287 | A1* | 9/2018 | Nishikawa | H01Q 5/335 |

FOREIGN PATENT DOCUMENTS

| | | |
|---|---|---|
| TW | I523334 B | 2/2016 |
| TW | M539158 U | 4/2017 |

OTHER PUBLICATIONS

Chinese language office action dated May 22, 2020, issued in application No. TW 108122731.

* cited by examiner

ANTENNA STRUCTURE

CROSS REFERENCE TO RELATED APPLICATIONS

This application claims priority of Taiwan Patent Application No. 108122731 filed on Jun. 28, 2019, the entirety of which is incorporated by reference herein.

BACKGROUND OF THE INVENTION

Field of the Invention

The disclosure generally relates to an antenna structure, and more particularly, it relates to a multiband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will affect the communication quality of the mobile device. Accordingly, it has become a critical challenge for antenna designers to design a wideband antenna element that is small in size.

BRIEF SUMMARY OF THE INVENTION

In an exemplary embodiment, the disclosure is directed to an antenna structure which includes a ground element, a feeding radiation element, a first radiation element, a second radiation element, a third radiation element, a first capacitor, and a second capacitor. The ground element has a notch region. The feeding radiation element has a feeding point. The first radiation element is coupled to the ground element. The first capacitor is coupled between the feeding radiation element and the first radiation element. The second radiation element is coupled to the ground element. The second capacitor is coupled between the first radiation element and the second radiation element. The third radiation element is coupled to the feeding radiation element. The feeding radiation element, the first radiation element, the second radiation element, the third radiation element, the first capacitor, and the second capacitor are all disposed inside the notch region of the ground element.

In some embodiments, the antenna structure covers a first frequency band at 1575 MHz, a second frequency band from 2400 MHz to 2500 MHz, and a third frequency band from 5150 MHz to 5850 MHz.

In some embodiments, each of the first radiation element and the second radiation element substantially has a straight-line shape. The first radiation element and the second radiation element are substantially parallel to each other.

In some embodiments, the third radiation element substantially has an L-shape.

In some embodiments, the feeding radiation element has a first end and a second end. The feeding point is positioned at the first end of the feeding radiation element.

In some embodiments, the first radiation element has a first end and a second end. The first end of the first radiation element is coupled to a first connection point on the ground element. The second end of the first radiation element is coupled through the first capacitor to the second end of the feeding radiation element.

In some embodiments, the second radiation element has a first end and a second end. The first end of the second radiation element is coupled to a second connection point on the ground element. The second end of the second radiation element is coupled through the second capacitor to the second end of the first radiation element.

In some embodiments, the third radiation element has a first end and a second end. The first end of the third radiation element is coupled to the second end of the feeding radiation element.

In some embodiments, the antenna structure further includes a matching radiation element having a first end and a second end. The first end of the matching radiation element is coupled to a third connection point on the feeding radiation element.

In some embodiments, the antenna structure further includes a first circuit element, a second circuit element, a third circuit element, a fourth circuit element, and a fifth circuit element. The first circuit element is coupled between the first end of the first radiation element and the first connection point on the ground element. The second circuit element is coupled between the first end of the second radiation element and the second connection point on the ground element. The third circuit element is coupled between the second end of the feeding radiation element and the first end of the third radiation element. The fourth circuit element is coupled between the second end of the third radiation element and a fourth connection point on the ground element. The fifth circuit element is coupled between the second end of the matching radiation element and a fifth connection point on the ground element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
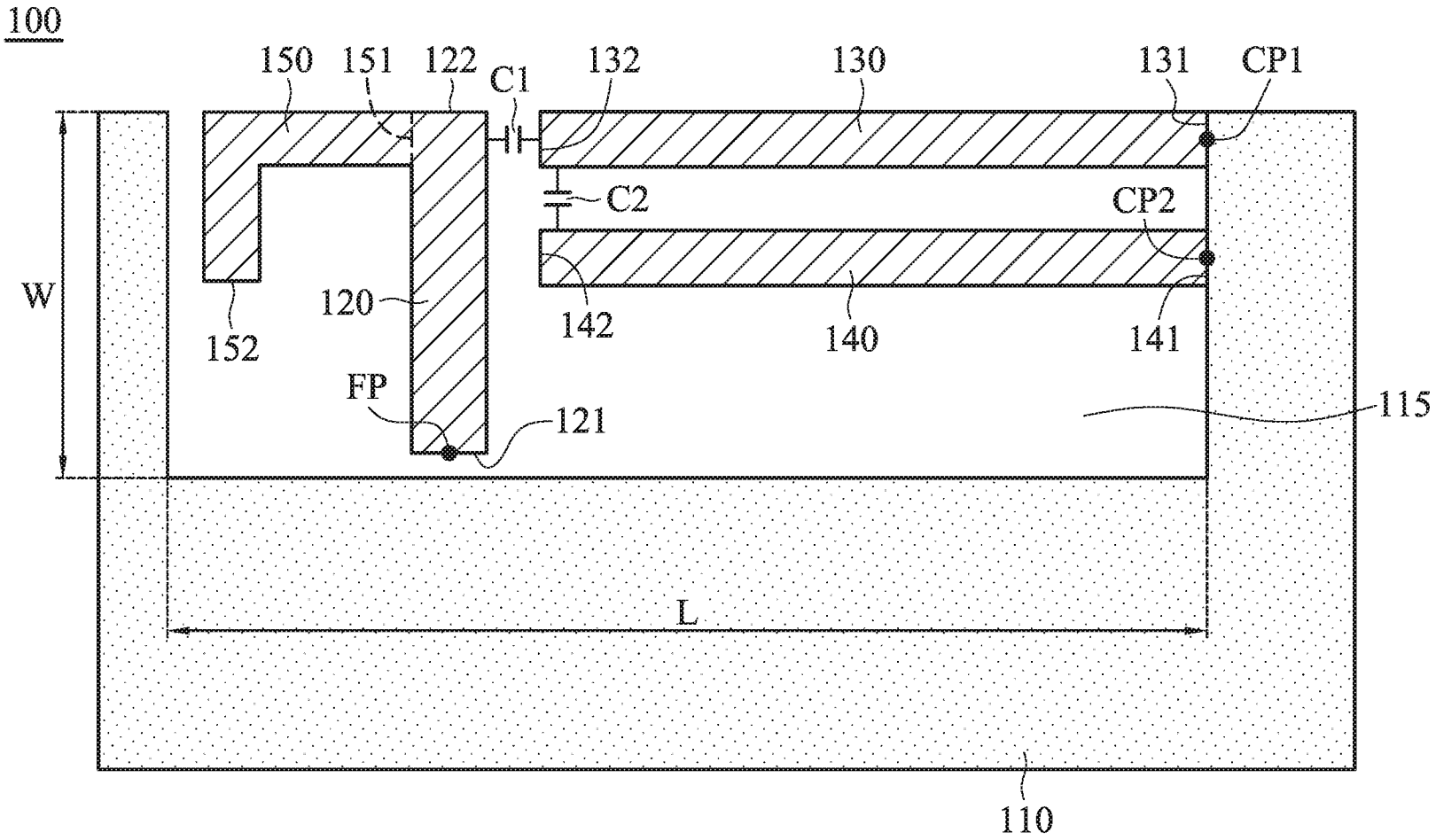
FIG. 1 is a top view of an antenna structure according to an embodiment of the invention.

FIG. 1 is a top view of an antenna structure 100 according to an embodiment of the invention. The antenna structure 100 may be applied in a mobile device, such as a smartphone, a tablet computer, or a notebook computer. As shown in FIG. 1, the antenna structure 100 includes a ground element 110, a feeding radiation element 120, a first radiation element 130, a second radiation element 140, a third radiation element 150, a first capacitor C1, and a second capacitor C2. The ground element 110, the feeding radiation element 120, the first radiation element 130, the second radiation element 140, and the third radiation element 150 may all be made of metal materials, such as copper, silver, aluminum, iron, or their alloys. Each of the first capacitor C1 and the second capacitor C2 may be a fixed capacitor or a variable capacitor.

The ground element 110 may be a metal plane for providing a ground voltage of the antenna structure 100. The ground element 110 has a notch region 115. The notch region 115 may substantially have a rectangular shape or a square shape. In some embodiments, the notch region 115 is substantially positioned at the central point of any edge of the ground element 110, and it is relatively far away from the corners of the ground element 110. It should be noted that the feeding radiation element 120, the first radiation element 130, the second radiation element 140, the third radiation element 150, the first capacitor C1, and the second capacitor C2 are all disposed inside the notch region 115 of the ground element 110.

The feeding radiation element 120 may substantially have a straight-line shape. Specifically, the feeding radiation element 120 has a first end 121 and a second end 122. A feeding point FP is positioned at the first end 121 of the feeding radiation element 120. The feeding point FP may be coupled to a signal source (not shown). For example, the aforementioned signal source may be an RF (Radio Frequency) module for exciting the antenna structure 100.

The first radiation element 130 may substantially have a straight-line shape. The first capacitor C1 is coupled between the feeding radiation element 120 and the first radiation element 130. Specifically, the first radiation element 130 has a first end 131 and a second end 132. The first end 131 of the first radiation element 130 is coupled to a first connection point CP1 on the ground element 110. The second end 132 of the first radiation element 130 is coupled through the first capacitor C1 to the second end 122 of the feeding radiation element 120.

The second radiation element 140 may substantially have a straight-line shape. In some embodiments, the first radiation element 130 and the second radiation element 140 are substantially parallel to each other. The length of the first radiation element 130 may be the same as the length of the second radiation element 140. The second capacitor C2 is coupled between the first radiation element 130 and the second radiation element 140. Specifically, the second radiation element 140 has a first end 141 and a second end 142. The first end 141 of the second radiation element 140 is coupled to a second connection point CP2 on the ground element 110. The second end 142 of the second radiation element 140 is coupled through the second capacitor C2 to the second end 132 of the first radiation element 130. The second connection point CP2 may be different from the aforementioned first connection point CP1.

The third radiation element 150 may substantially have an L-shape, which may be partially perpendicular to and partially parallel to the feeding radiation element 120. Specifically, the third radiation element 150 has a first end 151 and a second end 152. The first end 151 of the third radiation element 150 is coupled to the second end 122 of the feeding radiation element 120. The second end 152 of the third radiation element 150 is an open end. In some embodiments, the feeding radiation element 120 has a first side and a second side which are opposite to each other. The first radiation element 130 and the second radiation element 140 are both positioned at the first side (e.g., the right side) of the feeding radiation element 120. The third radiation element 150 is positioned at the second side (e.g., the left side) of the feeding radiation element 120. In other words, the feeding radiation element 120 may separate the third radiation element 150 from the first radiation element 130 and the third radiation element 150.

Figure 2:
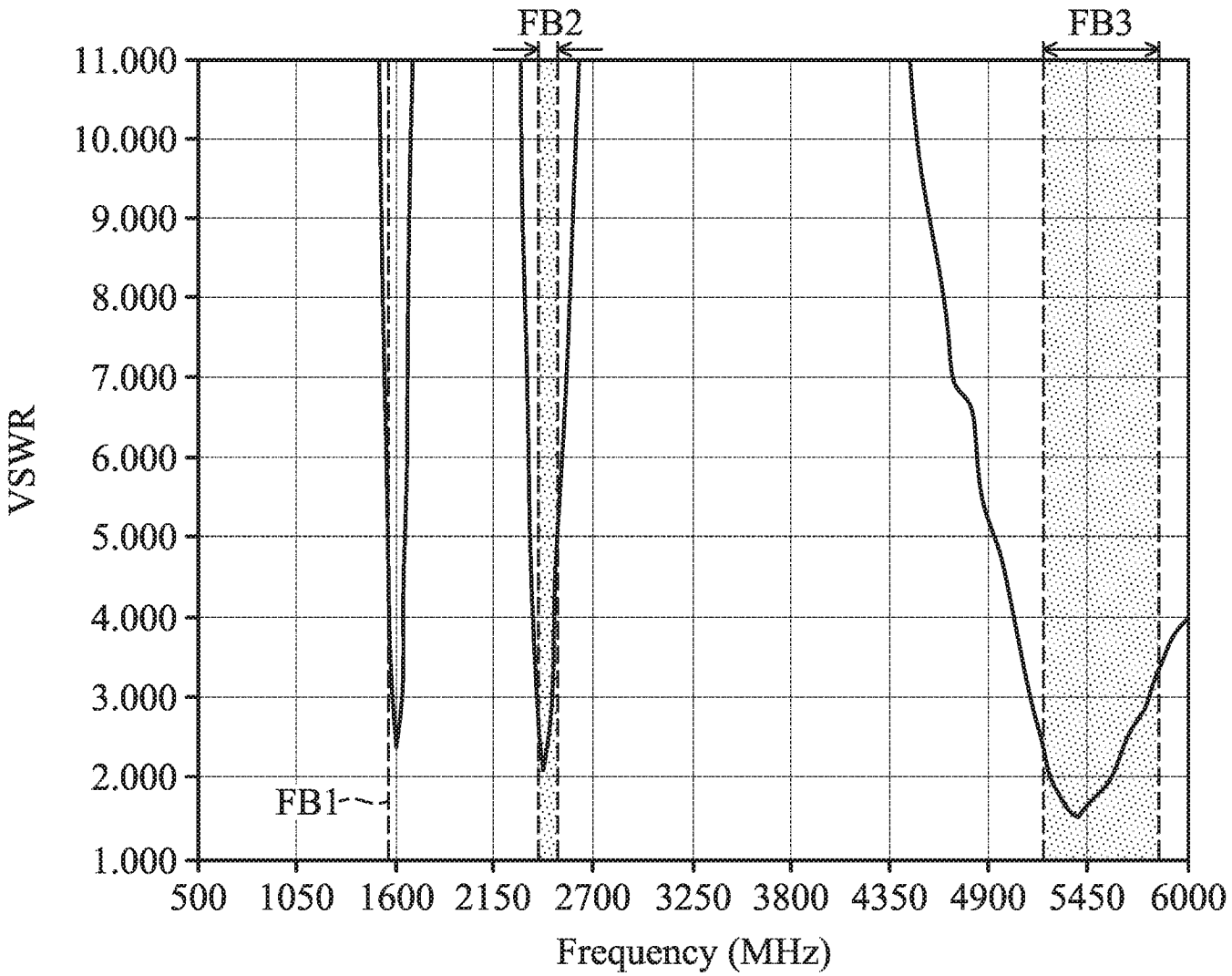
FIG. 2 is a diagram of VSWR (Voltage Standing Wave Ratio) of an antenna according to an embodiment of the invention.

FIG. 2 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 2, the antenna structure 100 can cover a first frequency band FB1, a second frequency band FB2, and a third frequency band FB3. The first frequency band FB1 may be substantially at 1575 MHz. The second frequency band FB2 may be substantially from 2400 MHz to 2500 MHz. The third frequency band FB3 may be substantially from 5150 MHz to 5850 MHz. Therefore, the antenna structure 100 can support at least the multiband operations of GPS (Global Positioning System) and WLAN (Wireless Local Area Networks) 2.4 GHz/5 GHz.

In some embodiments, the operation principles of the antenna structure 100 are described as follows. The feeding radiation element 120, the first capacitor C1, and the first radiation element 130 may be excited to generate the first frequency band FB1. The feeding radiation element 120, the first capacitor C1, the second capacitor C2, and the second radiation element 140 may be excited to generate the second frequency band FB2. In addition, the feeding radiation element 120 and the third radiation element 150 may be excited to generate the third frequency band FB3. According to practical measurements, the incorporation of the first capacitor C1 and the second capacitor can control the effective resonant length of each radiation element. Since all of the radiation elements and capacitors are positioned inside the notch region 115 of the ground element 110, they do not occupy additional design area, so as to minimize the total size of the antenna structure 100.

In some embodiments, the element sizes and element parameters of the antenna structure 100 are described as follows. The notch region 115 has a length L and a width W. The length L may be at least twice the width W. The product of the length L and the width W may be from 1/16 to 1/8 times the square of wavelength of the antenna structure 100

$$(\text{i.e., } \frac{\lambda^2}{16} \leq L \cdot W \leq \frac{\lambda^2}{8},$$

where "λ" represents the wavelength of the lowest frequency of the first frequency band FB1 of the antenna structure 100). The capacitance of the second capacitor C2 may be greater than the capacitance of the first capacitor C1. The capacitance of the first capacitor C1 may be smaller than 1 pF, such as 0.6 pF. The capacitance of the second capacitor C2 may be smaller than 1 pF, such as 0.8 pF. The above ranges of element sizes and element parameters are calculated and obtained according to many experiment results, and they help to optimize the operation bandwidth and impedance matching of the antenna structure 100.

Figure 3:
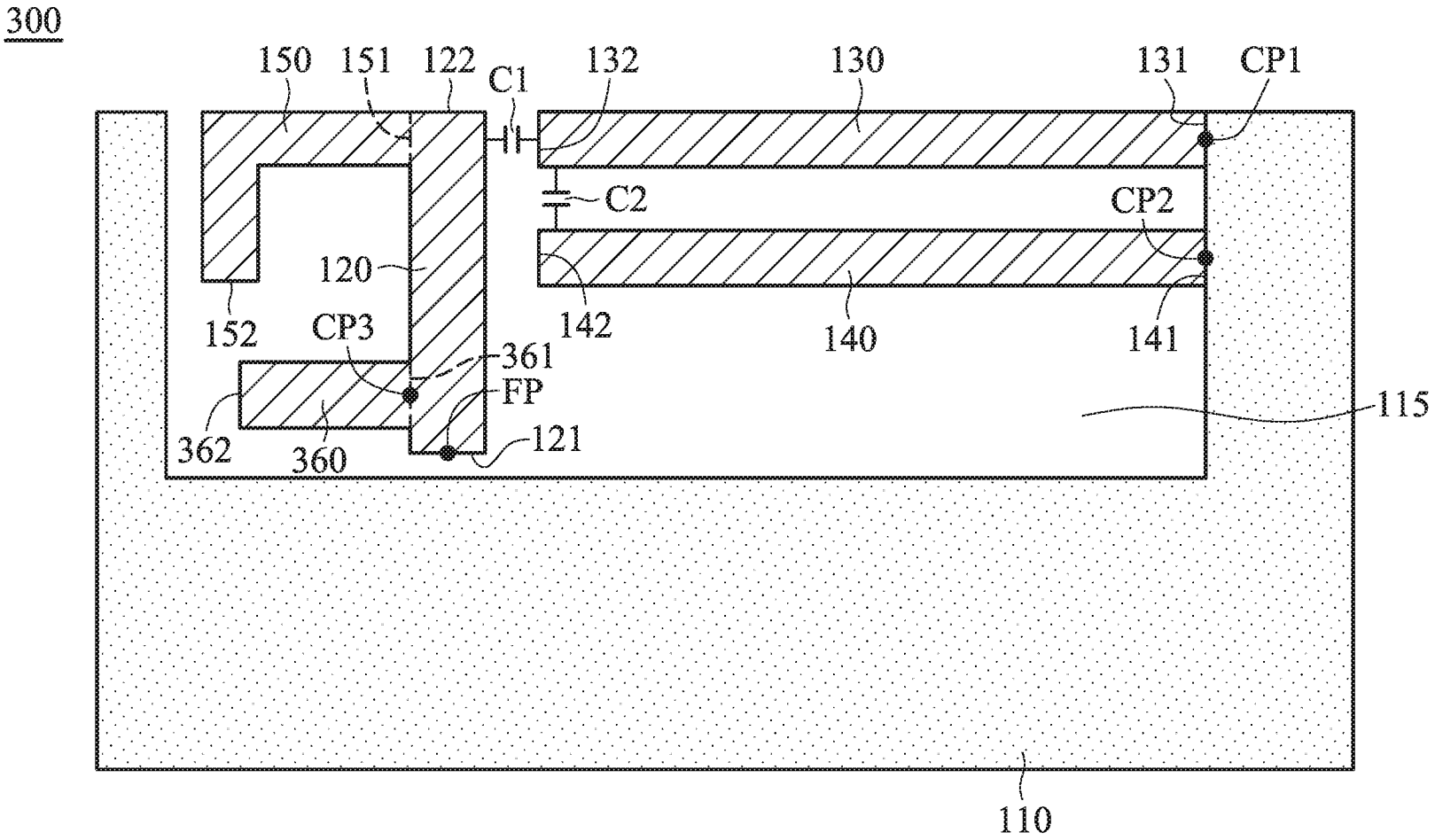
FIG. 3 is a top view of an antenna structure according to another embodiment of the invention.

FIG. 3 is a top view of an antenna structure 300 according to another embodiment of the invention. FIG. 3 is similar to FIG. 1. In the embodiment of FIG. 3, the antenna structure 300 further includes a matching radiation element 360, which may be made of a metal material. The matching radiation element 360 may substantially have a straight-line shape, which may be substantially perpendicular to the feeding radiation element 120. Specifically, the matching radiation element 360 has a first end 361 and a second end 362. The first end 361 of the matching radiation element 360 is coupled to a third connection point CP3 on the feeding radiation element 120. The second end 362 of the matching radiation element 360 is an open end, which is adjacent to the second end 152 of the third radiation element 150. It should be noted that the term "adjacent" or "close" over the disclosure means that the distance (spacing) between two corresponding elements is smaller than a predetermined distance (e.g., 10 mm or shorter), or it means that the two corresponding elements are touching each other directly (i.e., the aforementioned distance/spacing therebetween is reduced to 0). The third connection point CP3 is positioned between the first end 121 and the second end 122 of the feeding radiation element 120, and the third connection point CP3 is relatively close to the first end 121 of the feeding radiation element 120. According to practical measurements, the incorporation of the matching radiation element 360 can improve the impedance matching of any frequency band of the antenna structure 300. Other features of the antenna structure 300 of FIG. 3 are similar to those of the antenna structure 100 of FIG. 1. Accordingly, the two embodiments can achieve similar levels of performance.

Figure 4:
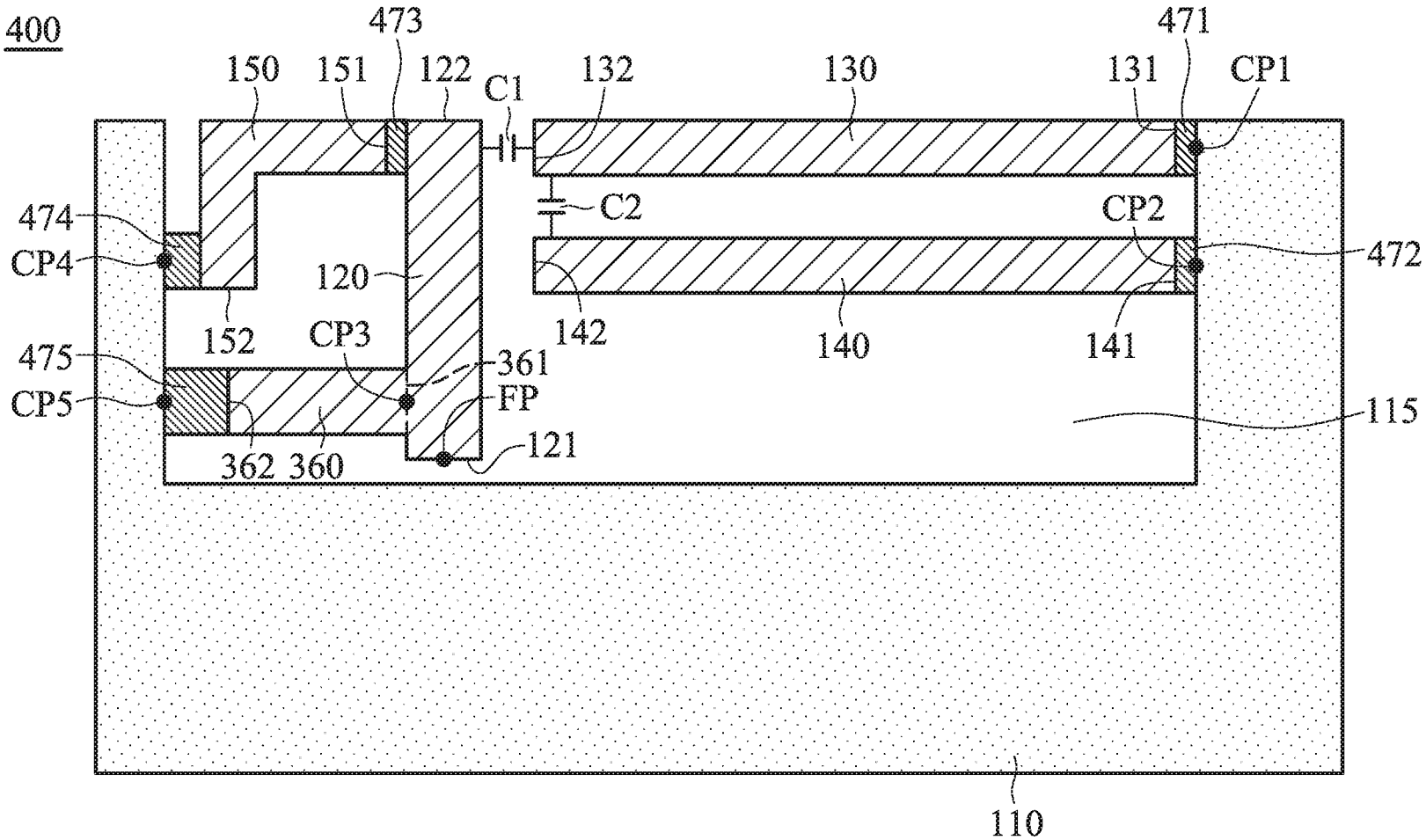
FIG. 4 is a top view of an antenna structure according to another embodiment of the invention.

FIG. 4 is a top view of an antenna structure 400 according to another embodiment of the invention. FIG. 4 is similar to FIG. 3. In the embodiment of FIG. 4, the antenna structure 400 further includes a first circuit element 471, a second circuit element 472, a third circuit element 473, a fourth circuit element 474, and a fifth circuit element 475. For example, any of the first circuit element 471, the second circuit element 472, the third circuit element 473, the fourth circuit element 474, and the fifth circuit element 475 may be a resistor, a capacitor, an inductor, a short-circuited element, or an open-circuited element. The first circuit element 471 is coupled between the first end 131 of the first radiation element 130 and the first connection point CP1 on the ground element 110. The second circuit element 472 is coupled between the first end 141 of the second radiation element 140 and the second connection point CP2 on the ground element 110. The third circuit element 473 is coupled between the second end 122 of the feeding radiation element 120 and the first end 151 of the third radiation element 150. The fourth circuit element 474 is coupled between the second end 152 of the third radiation element 150 and a fourth connection point CP4 on the ground element 110. The fifth circuit element 475 is coupled between the second end 362 of the matching radiation element 360 and a fifth connection point CP5 on the ground element 110. The fifth connection point CP5 may be different from the aforementioned fourth connection point CP4. In some embodiments, each of the first circuit element 471, the second circuit element 472, the third circuit element 473, and the fifth circuit element 475 is a short-circuited element or an inductor, and the fourth circuit element 474 is an open-circuited element or a capacitor. According to practical measurements, the incorporation of the first circuit element 471, the second circuit element 472, the third circuit element 473, the fourth circuit element 474, and the fifth circuit element 475 can fine-tune the impedance matching of the first frequency band FB1, the second frequency band FB2, and the third frequency band FB3 of the antenna structure 400, thereby optimizing the radiation performance of the antenna structure 400. Other features of the antenna structure 400 of FIG. 4 are similar to those of the antenna structure 300 of FIG. 3. Accordingly, the two embodiments can achieve similar levels of performance.

The invention proposes a novel wideband antenna structure, which at least includes a plurality of radiation elements and capacitors disposed inside a notch region of a ground element. In conclusion, the invention has at least the advantages of small size, wide bandwidth, high radiation efficiency, and low manufacturing cost, and therefore it is suitable for application in a variety of mobile communication devices.

Note that the above element sizes, element shapes, element parameters, and frequency ranges are not limitations of the invention. An antenna designer can fine-tune these settings or values according to different requirements. It should be understood that the antenna structure of the invention is not limited to the configurations of FIGS. 1-4. The invention may merely include any one or more features of any one or more embodiments of FIGS. 1-4. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground element, having a notch region;

a feeding radiation element, having a feeding point;

a first radiation element, coupled to the ground element;

a first capacitor, coupled between the feeding radiation element and the first radiation element;

a second radiation element, coupled to the ground element;

a second capacitor, coupled between the first radiation element and the second radiation element; and a third radiation element, coupled to the feeding radiation element;

wherein the feeding radiation element, the first radiation element, the second radiation element, the third radiation element, the first capacitor, and the second capacitor are all disposed inside the notch region of the ground element;

wherein the feeding radiation element has a first end and a second end, and the feeding point is positioned at the first end of the feeding radiation element;

wherein the first radiation element has a first end and a second end, the first end of the first radiation element is coupled to a first connection point on the ground element, and the second end of the first radiation element is coupled through the first capacitor to the second end of the feeding radiation element;

wherein the second radiation element has a first end and a second end, the first end of the second radiation element is coupled to a second connection point on the ground element, and the second end of the second radiation element is coupled through the second capacitor to the second end of the first radiation element;

wherein the third radiation element has a first end and a second end, and the first end of the third radiation element is coupled to the second end of the feeding radiation element;

wherein the antenna structure further comprises:

a matching radiation element, having a first end and a second end, wherein the first end of the matching radiation element is coupled to a third connection point on the feeding radiation element;

a first circuit element, coupled between the first end of the first radiation element and the first connection point on the ground element;

a second circuit element, coupled between the first end of the second radiation element and the second connection point on the ground element;

a third circuit element, coupled between the second end of the feeding radiation element and the first end of the third radiation element;

a fourth circuit element, coupled between the second end of the third radiation element and a fourth connection point on the ground element; and a fifth circuit element, coupled between the second end of the matching radiation element and a fifth connection point on the ground element.

2. The antenna structure as claimed in claim 1, wherein the antenna structure covers a first frequency band at 1575 MHz, a second frequency band from 2400 MHz to 2500 MHz, and a third frequency band from 5150 MHz to 5850 MHz.

3. The antenna structure as claimed in claim 1, wherein each of the first radiation element and the second radiation element substantially has a straight-line shape, and the first radiation element and the second radiation element are substantially parallel to each other.

4. The antenna structure as claimed in claim 1, wherein the third radiation element substantially has an L-shape.

* * * * *